US006957812B2

(12) United States Patent
Wittig

(10) Patent No.: US 6,957,812 B2
(45) Date of Patent: Oct. 25, 2005

(54) COLOR-LINKED MINIATURE GAME APPARATUS

(76) Inventor: Michael Brian Wittig, 111 Saratoga Ave. #2326, Santa Clara, CA (US) 95051

( * ) Notice: Subject to any disclaimer, the term of this patent is extended or adjusted under 35 U.S.C. 154(b) by 0 days.

(21) Appl. No.: 10/435,424

(22) Filed: May 9, 2003

(65) Prior Publication Data

US 2004/0012148 A1 Jan. 22, 2004

Related U.S. Application Data

(60) Provisional application No. 60/379,061, filed on May 9, 2002.

(51) Int. Cl.[7] ..... A63F 3/00

(52) U.S. Cl. ..... 273/236; 273/242; 273/255; 273/262

(58) Field of Search ..... 273/236, 242, 273/255, 262

(56) References Cited

U.S. PATENT DOCUMENTS 4,913,443 A * 4/1990 Currey, Jr. ..... 273/244
5,120,066 A * 6/1992 Cohen ..... 273/258

* cited by examiner

*Primary Examiner*—Vishu K. Mendiratta

(57) ABSTRACT

The present invention includes an apparatus that can be used for easily relating properties of a miniature to an off-miniature reference. Because the game properties are off the miniature, there is unlimited space available for tracking them.

7 Claims, 2 Drawing Sheets

COLOR-LINKED MINIATURE GAME APPARATUS

CROSS-REFERENCE TO RELATED APPLICATIONS

This application claims the benefit of U.S. Provisional Application No. 60/379,061, filed on May 9, 2002, the entire disclosure of which is hereby incorporated by reference herein.

BACKGROUND OF THE INVENTION

1) Field of Invention

This invention relates to role-playing, board, and miniature-based games in particular. It also relates to any simulation requiring miniatures.

2) Discussion of Related Art

Miniatures are game pieces shaped to represent creatures or objects. Chess pieces, civil war miniatures, and plastic army men are common examples. Games that employ such miniatures often include a set of rules that assign each piece particular properties that are relevant to the rules. Traditionally, the properties are kept track of on one or more pieces of paper. When a couple miniatures are used in a game, each with different properties, keeping track of which miniature has which properties can become confusing. Writing on paper must be related to the appearance or markings of each miniature, which cannot be done at a glance. Sometimes, each miniature is assigned a card listing its individual properties. Again, relating the miniatures to these cards becomes troublesome because it requires that the appearance or markings of the miniature be related to the writing or picture on the card. When players are opposite each other, as is often the case, the book-keeping becomes even more of a headache, as a card cannot be right-side-up for both players, and if the table is large enough, both players are not close enough to read the text at the same time.

Recently, miniatures have been introduced with features to help track such properties without paper. For example, Games Workshop of Nottingham, England produced a line of miniatures in the early 1990's with a rotating disk built into the base of each miniature that could track the value of a game property assigned to the miniature. The disk could be rotated by the thumb manually. Similarly, Wizkids LLC of Bellevue, Wash. produces miniatures that have a rotating base that indicates several game properties. The miniature is picked up, its top section held stationary in one hand while its base is rotated with the other. Like the Games Workshop miniatures, an internal disk labeled with various game values rotates within the base of the miniature; the "current" game value or values is indicated by the labeling on the section of the disk appearing at a window cut on the top of the miniature's base.

A problem arising with these new miniatures is the fact that there is a very limited amount of space on each miniature to use for property tracking. Fitting a large number of properties on each miniature is exceedingly difficult.

SUMMARY OF THE INVENTION

It is an objective of the present invention to overcome some or all of the above limitations. The present invention includes an apparatus that can be used for easily relating properties of a miniature to an off-miniature reference. Because the game properties are off the miniature, there is unlimited space available for tracking them.

In the preferred embodiment of the invention, each miniature has a uniquely colored base. A cardboard plate of each color is placed to the side of the game. Game effects and properties related to a miniature can be tracked by placing cards, markers, etc. . . . on the cardboard plate of the color that corresponds to the miniature involved. The following advantages are realized:

1) The effects and properties off the board corresponding to a particular miniature are instantly recognizable, even among many miniatures and many cards, at a glance and without any reading.

2) The relationship formed with color is language-independent.

3) The relationship formed with color is recognizable regardless of the position or orientation of the miniatures or cards.

4) There is virtually no space limitation on the amount of game information that can be tracked for each miniature.

For purposes of summarizing the invention and the advantages achieved over the prior art, certain objects and advantages of the invention have been described herein above. It is to be understood that not necessarily all such objects or advantages may be achieved in accordance with any particular embodiment of the invention. For example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE INVENTION

Figure 1:
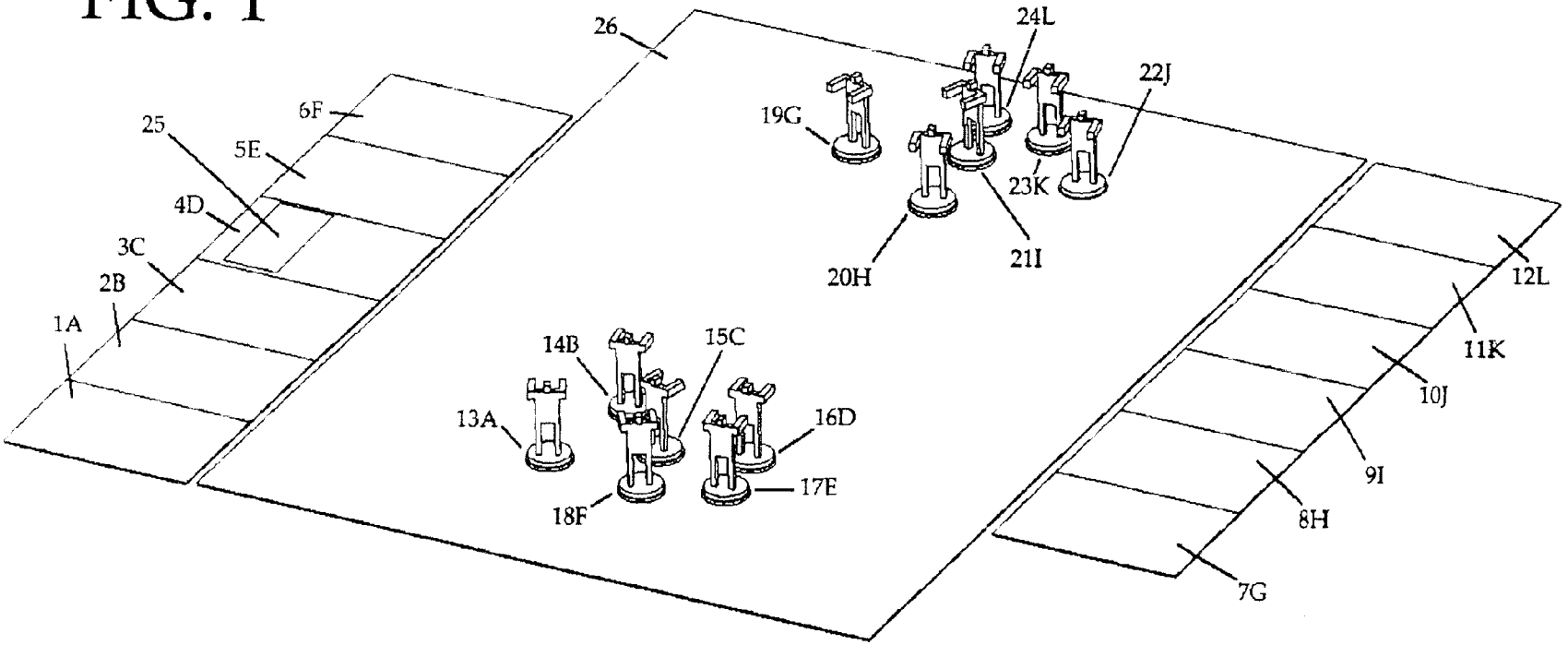
FIG. 1 is a perspective view of the preferred embodiment of the invention.

FIG. 1 of the accompanying drawings illustrates the preferred embodiment of the apparatus of the invention. Letters in the marking of each item in the drawing denote colors. Items of corresponding colors therefore have the same letters of the alphabet in their designations. For example, Miniature 13A has the same color marking as Cardboard Plate 1A, Miniature 17E has the same color marking as Cardboard Plate 5E, and so on. As a further example, Cardboard Plate 1A and Miniature 13A are red, Cardboard Plate 2B and Miniature 14B are blue, Cardboard Plate 3C and Miniature 15C are green, and so on. Playing Card 25 is placed on Cardboard Plate 4D to designate that its game properties are applied to Miniature 16D, which shares the same color as Cardboard Plate 4D. In the preferred embodiment, Playing Surface 26 is a vinyl mat ruled with a grid pattern, like graph paper, to aid in the positioning of Miniatures.

Figure 2:
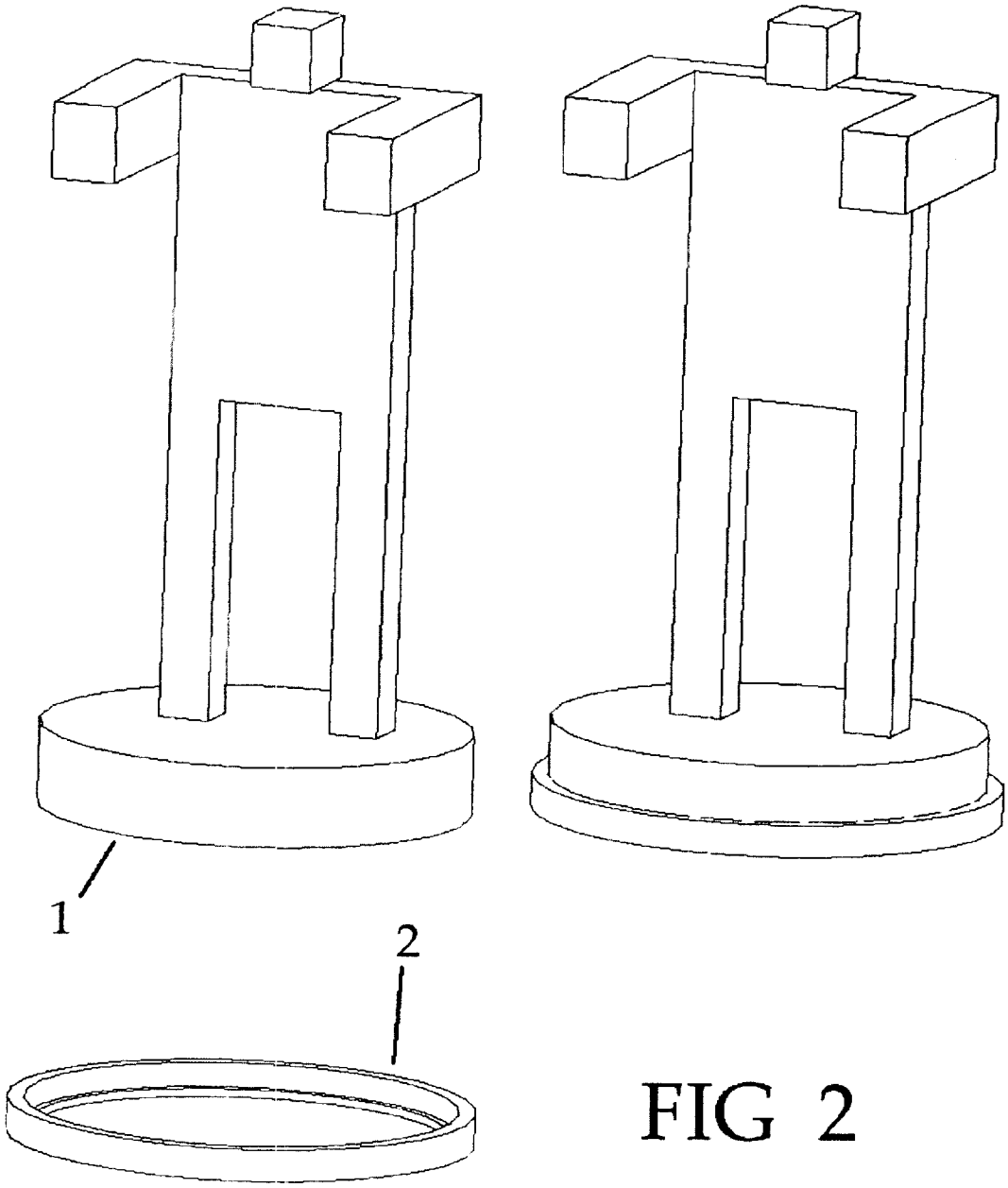
FIG. 2 is a perspective view of a miniature and snap-on color ring of the preferred embodiment.

FIG. 2 shows how Figurine 1 and Colored Snap Ring 2 mate together to form a Miniature. Both are made out of plastic in the preferred embodiment. A player may have many Figurines available for a particular game, but may choose only a handful to play with at a time. It is therefore advantageous to be able to have a smaller set of Colored Snap Rings that need only be applied to miniatures that will actually be used in a particular game. The Figurines used may vary from game to game, and therefore Colored Snap Rings may be removed from Figurines used in one game and applied to different Figurines for another game.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

For example, it is not necessary to include Playing Surface 26.

Playing Card 25 could be replaced with other forms of game representations, such as molded plastic pieces in the shape of weapons or other counters or markers.

Cardboard Plates 1A–12L could be replaced with plates of other materials, or other shapes of materials, such as boxes or rings.

Cardboard Plates 1A–12L could be replaced with colored regions marked on Playing Surface 26 instead.

Colored Snap Ring 2 could be in a different form, such as a circular plate that sits beneath Figurine 1 or a peg that is inserted into the base of Figurine 1.

What is claimed:

1. A game comprising: A plurality of miniature game pieces; a plurality of component pieces, wherein each component piece having a color distinct from each other; the component pieces further configured to be mounted on a respective one of said game pieces to designate the game piece color corresponding to the color of the component; a playing region for placing said game pieces; a plurality of additional surfaces outside the region wherein each surface respectively having the same color of a corresponding game piece defining color; a plurality of game items representing game piece properties, wherein a game item occupies an area corresponding with one of the said additional surfaces to indicate a property of the said game piece of the corresponding color.

2. The game piece of claim 1, wherein said game items are cards.

3. The game piece of claim 1, wherein said game items are plastic pieces.

4. The game piece of claim 1, wherein said game items are counters.

5. The game piece of claim 1, wherein said game items are markers.

6. The game piece of claim 1, wherein said additional surface is part of a cardboard plate.

7. The game piece of claim 1, wherein said additional surface is part of a box.

* * * * *